United States Patent [19]

Rellermeyer et al.

[11] Patent Number: 4,592,777

[45] Date of Patent: Jun. 3, 1986

[54] METHOD, PROCESS AND COMPOSITION FOR DESULFURIZING PIG-IRON MELTS

[75] Inventors: Heinrich Rellermeyer, Duisburg; Walter Meichsner, Krefeld; Werner Gmöhling, Hufschlag, all of Fed. Rep. of Germany

[73] Assignees: Thyssen Stahl AG, Dusseldorf; SKW Trostberg AG, Trostberg, both of Fed. Rep. of Germany

[21] Appl. No.: 681,174

[22] Filed: Dec. 13, 1984

[30] Foreign Application Priority Data

May 16, 1984 [DE] Fed. Rep. of Germany ..... 3418075

[51] Int. Cl.[4] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,929,464 | 12/1975 | Todd | 75/58 |
| 3,998,625 | 12/1976 | Koros | 75/58 |
| 4,137,072 | 1/1979 | Kawakami | 75/58 |
| 4,139,369 | 2/1979 | Kaudler | 75/58 |
| 4,159,906 | 7/1979 | Meichsner | 75/58 |
| 4,209,325 | 6/1980 | Cooper | 75/58 |
| 4,286,984 | 9/1981 | Luyckx | 75/58 |
| 4,395,282 | 7/1983 | Braun | 75/58 |

*Primary Examiner*—Peter D. Rosenberg

*Attorney, Agent, or Firm*—Sprung, Horn, Kramer & Woods

[57] ABSTRACT

A method and composition for desulfurization of hot metal is disclosed. To the hot metal there is added a composition comprising calcium carbide, a hydrogen releasing compound and magnesium.

49 Claims, No Drawings

METHOD, PROCESS AND COMPOSITION FOR DESULFURIZING PIG-IRON MELTS

BACKGROUND OF THE INVENTION

1. Field of the Invention

The present invention relates to a method of desulfurizing pig-iron melts and a composition used for such desulfurization.

2. Discussion of Prior Art

The increasing contents of sulfur in ores and other materials used in pig iron production, e.g., coal and coke make it absolutely essential to desulfurize pig iron outside the blast furnace. A wide range of materials and methods that lead to satisfactory levels of desulfurization are known. Mixtures based on calcium carbide and diamide lime (U.S. Pat. No. 3,598,573) are preferred. Compounds containing calcium in combination with hydrocarbons like oil or paraffin (French Patent 1,166,389 and U.S. Pat. No. 2,863,755) have also been proposed, German Auslegeschrift 2,531,047 proposes a method of desulfurizing pig iron that employs a desulfurizing agent containing calcium carbide, calcium cyanamide or lime plus 0.5 to 3.5% of powdered aluminum or magnesium in terms of the calcium compounds. U.S. Pat. No. 4,049,442 discloses desulfurizing with a mixture of calcium carbide and diamide lime wherein the content of the diamide lime is from 40 to 70% by weight of the desulfurizing composition. U.S. Pat. No. 4,154,606 discloses a desulfurization agent containing at least one alkaline earth metal carbonate and at least one reducing metal carbide and optionally a reducing metal or an alloy thereof.

The aforesaid desulfurizing agents, especially those based on calcium carbide in combination with diamide lime or calcium carbonate, have been introduced into the art and are manufactured in large quantities and employed in the iron and steel industry.

The gas-releasing components are intended to distribute the finely milled particles of desulfurizing agent throughout the melt. The release of carbon dioxide from carbonate constituents, however, can under the conditions prevailing in the pig-iron melts, lead to oxidation processes as a result of dissociation into carbon monoxide and oxygen. Part of the desulfurization-active compounds are accordingly lost to the desulfurizing reaction. Hence, the efficiency of the desulfurant in terms of percent sulfur reduction per unit weight of desulfurant per unit weight hot metal is in need of improvement.

Even the desulfurization employing mixtures of lime and magnesium described in U.S. Pat. Nos. 3,998,625 and 4,266,969 entails the drawback of large slag volumes due to the practical lack of a desulfurizing effect on the part of the lime.

The problem accordingly exists of providing a method of desulfurizing pig iron that eliminates or reduces these drawbacks and which permits use of short desulfurization times while keeping slag generation at a low level.

SUMMARY OF THE INVENTION

These and other objects and advantages are achieved in accordance with this invention by a method for desulfurizing pig iron which comprises introducing into said pig iron a composition comprising:

(A) calcium carbide and at least one compound which under the conditions of said pig iron release hydrogen; and (B) magnesium.

Component A and Component B can be introduced into the pig iron (hot metal) simultaneously and, if desired, from separate sources.

The process is performed preferably by injecting the desulfurization components into molten pig iron such that it is inserted into the molten pig iron below its liquid level. This can be done using an immersion lance through which the desulfurant is passed. To this end, it is preferred that the desulfurant or at least a portion thereof be fluidized in a fluidizing dispenser and while in such state be injected via the immersion lance into the molten pig iron, preferably at a point well below, e.g., 2–3 meters below the liquid level of the molten pig iron.

It is preferred that the desulfurization be a so called "external desulfurization", i.e., one taking place outside the blast furnace such as in open ladles, transfer ladles or those known as torpedo ladles or bottles. A suitable apparatus for such purpose is disclosed in U.S. Pat. Nos. 3,807,602 and 3,955,966.

Using calcium carbide and a compound that at least predominantly releases hydrogen can produce the following effects:

(a) The calcium carbide itself develops a powerful desulfurizing effect in the iron melt, decreasing the total amount of desulfurization agent that must be introduced into the pig iron.

(b) The hydrogen released from the compound supplying the same at the temperatature of the melt extensively impedes oxidation of the calcium carbide and magnesium.

(c) The released hydrogen gas intimately mixes the reaction constituents with the melt being desulfurized and circulates the melt bath, thereby improving pig iron/desulfurant contact.

One can mix Components A and B together before injecting it into the molten pig iron. When co-mixed, they can be pneumatically conveyed and injected into the pig iron. It has, however, turned out to be practical to prepare and store the Component A and the magnesium separately and to combine them only in the supply line or in the lance, introducing them into the melt simultaneously.

The method of desulfurizing pig-iron melts is further characterized in that a mixture of calcium carbide and a compound that predominantly releases hydrogen is employed as Component A.

Although the calcium carbide to be employed is in particular a commercially available calcium carbide containing 70 to 85% $CaC_2$, so called "carbide", with $CaC_2$ contents of 65% or less, can also be used.

Any hydrocarbon or halogenated hydrocarbon that is solid at room temperature, such as polyethylene, polypropylene, polyvinyl chloride, or polystyrene, for example, can be employed as the compound that at least predominantly releases hydrogen in Component A. Liquid hydrocarbons, or halogenated hydrocarbon with boiling points of 50° to 350° C. can also be employed. The hydrocarbons are preferably absorbed into porous organic or inorganic materials that subsequently contain a multiple of their weight in hydrocarbon. Preferred porous materials are polyurethane foams, peat, or expanded stone, Gaseous hydrocarbons or chlorinated hydrocarbons can also be used including those which become gaseous under the temperatures of the hot metal being desulfurized. Included are ethane propane, n-butane, i-butane. If a gaseous hydrocarbon is used, it can be used as some or all of the gas used to convey the solid desulfurant into the molten pig iron.

Calcium carbonate, dolomite, or diamide lime can if necessary be mixed into the Component A in an amount such that the volume of carbon dioxide generated is less than the volume of the hydrogen released by the hydrogen-releasing compound. These carbon-dioxide releasing compounds can also be ground along with the calcium carbide. Such low levels of carbon dioxide cause practically no oxidation of the magnesium or calcium carbide in the melt.

Finally, the Component A can also contain 1to 10% by weight of fluorspar, cryolite, colemanite, or other constituents that improve the properties of the slag. Residues from the production of aluminum or magnesium can even be employed.

If necessary, small amounts of commercially available flow promoters like graphite, organic amines, alcohols, esters, or silicones can also be added to the Component A.

The constituents of the Component A are reduced in size by means of intense grinding and mixing, preferably in a tube mill and in an inert-gas atmosphere, until 90% of the calcium carbide has a particle size of less than 90μm and 50% a particles size of less than 50μm. Slight deviations are insignificant. The magnesium can be mixed in powdered form into the Component A, while it is in the mill or even later, until the Component A exhibits a ratio of between 85 and 99% by weight of calcium carbide to between 1 and 15% by weight of hydrogen-releasing compound.

The method in accordance with the invention is preferably carried out by injecting 50 to 85% by weight of the Component A and 15 to 50% by weight of powdered magnesium into the melt simultaneously. It can also be practical to inject 65 to 85% by weight of the Component A, which can also if necessary contain about as much of an alkaline earth metal carbonate, dolomite, or diamide lime as it does of the hydrocarbon, up to 5% by weight if necessary of fluorspar, and low levels (up to 0.5% by weight) of a flow promoter, into the pig-iron melts simultaneously with 15 to 35% by weight of the powdered magnesium.

Another characteristic of the method in accordance with the invention is that 10 to 100 kg and preferably 15 to 80 kg per minute of the desulfurizing agent comprising Component A and the magnesium is blown into the iron melt. Only 3 to 20 liters of conveying gas per kilogram of desulfurizing agent need to be employed to attain the optimal desulfurizing effect. The aforesaid desulfurizing mixtures are just as useful in conjunction with the method of injection for desulfurizing pig iron in a torpedo ladle as in a transfer ladel. The low demand for conveying gas is especially noteworthy in the latter case because the composition of the mixture guarantees a distribution that is adequate for a high utilization efficiency of the desulfurizing agent.

The desulfurizing mixture is preferably pneumatically introduced into the melt as deeply as possible with an appropriate immersion lance. Argon, natural gas, propane, and mixtures thereof with 10 to 90% by volume of nitrogen are appropriate conveying gases. The desulfurizing agents can also be injected into the melts with nitrogen alone.

The method in accordance with the invention surprisingly exhibits considerable advantages over methods in accordance with the state of the art. Either the level of desulfurization is noticeably higher or the amount of desulfurizing agent consumed for the same level of desulfurization is noticeably reduced.

Since they are not consumed in oxidation processes, the compounds that effect the desulfurization of the iron melts, specifically the calcium carbide and the alkaline earth metal are completely available to the desulfurization reaction in combination with the compounds that release the hydrogen.

Since the low reagent amounts employed keep treatment times short, the temperature losses of the melt are very small. Since the amounts of slag generated are low, the loss of iron in skimming the slag is insignificant.

The following examples are intended to illustrate the invention without limiting it in any way.

EXAMPLES

Table 1 below sets forth the mean results in each case of at least three desulfurization treatments with the identified reagents using an injection device of the type claimed in U.S. Pat. No. 3,807,602.

Results 1 through 4 were obtained with conventional desulfurizing agents based on calcium carbide and diamide lime or calcium hydroxide and carbon or lime and magnesium.

Results 5 though 8 were obtained with desulfurizing agents in accordance with the invention. All treatments were conducted in transfer ladles with capacities of 250 to 400 tonnes of pig iron.

TABLE 1

| Treatment: | 1 | 2 | 3 | 4 | 5 | 6 | 7 | 8 |
|---|---|---|---|---|---|---|---|---|
| $S_o$ | 0.030 | 0.059 | 0.027 | 0.061 | 0.040 | 0.063 | 0.047 | 0.021 |
| $S_f$ | 0.012 | 0.012 | 0.005 | 0.011 | 0.009 | 0.012 | 0.016 | 0.005 |
| Tonnes of pig iron | 210 | 200 | 220 | 190 | 200 | 220 | 320 | 310 |
| Mixture | 75 $CaC_2$<br>25 diam. | 75 $CaC_2$<br>25 diam. | 75 $CaC_2$<br>20 $Ca(OH_2)$<br>5 C | 70 CaO<br>30 Mg | 75 $CaC_2$<br>22 Mg<br>3 PE | 65 $CaC_2$<br>30 Mg<br>5 PE | 72 $CaC_2$<br>18 Mg<br>5 PP<br>5 $CaF_2$ | 67 $CaC_2$<br>28 Mg<br>5 PE |
| Kg/tonne | 3.4 | 5.9 | 4.5 | 2.8 | 1.0 | 1.33 | 1.3 | 0.57 |
| % S reduction per Kg desulfurant/tonnes pig | 0.0053 | 0.0080 | 0.0049 | 0.0179 | 0.0310 | 0.0383 | 0.0383 | 0.0281 |
| Kg/min | 65 | 65 | 75 | 25 | 30 | 32 | 55 | 42 |
| Conveying gas | dried compressed air | $N_2$ | dried compressed air | $N_2$ | propane | $N_2$ | Ar | Ar |
| N1/min | 380 | 380 | 350 | 450 | 270 | 420 | 360 | 400 |
| N1/kg | 5.8 | 5.8 | 4.7 | 18 | 9.0 | 13.4 | 6.5 | 9.5 |

Abbreviations $S_o$ initial sulfur content of the melt $S_f$ final sulfur content (subsequent to treatment)

TABLE 1-continued

| Treatment: | 1 | 2 | 3 | 4 | 5 | 6 | 7 | 8 |
|---|---|---|---|---|---|---|---|---|
| kg/tonne | amount of desulfurizing agent per tonne of pig iron | | | | | | | |
| kg/min | rate of injection of desulfurizing agent per minute | | | | | | | |
| Nl/min | volume of conveying gas in standard liters per minute | | | | | | | |
| Nl/kg | volume of conveying gas per kg of desulfurizing mixture | | | | | | | |
| $CaC_2$ | technical calcium carbide | | | | | | | |
| $Ca(OH)_2$ | calcium hydroxide (dry) | | | | | | | |
| CaO | lime | | | | | | | |
| Mg | magnesium | | | | | | | |
| PE | polyethylene | | | | | | | |
| PP | polypropylene | | | | | | | |
| $CaF_2$ | flurospar | | | | | | | |

What is claimed is:

1. A method for desulfurizing pig-iron which comprises introducing into said pig-iron a composition comprising:

(A) calcium carbide and at least one compound which under the conditions of said pig-iron releases hydrogen; and (B) magnesium.

2. A method according to claim 1 wherein Components A and B are introduced into said pig-iron simultaneously.

3. A process according to claim 1 wherein Components A and B are fluidized in a fluidized dispenser and while fluidized injected below the level of molten pig-iron.

4. A process according to claim 3 wherein Components A and B are introduced into a common conveying line from separate fluid dispensers and injected below the level of molten pig iron through an immersed lance.

5. A process according to claim 1 wherein Component A comprises calcium carbide wherein at least 90% thereof has a particle size less than 90μm and at least 50% of said calcium carbide has a particle size less than 50μm.

6. A process according to claim 1 wherein said compound which under the conditions of said pig-iron releases hydrogen is a hydrocarbon.

7. A process according to claim 5 wherein said compound which under the conditions of said pig-iron releases hydrogen is a hydrocarbon.

8. A process according to claim 6 wherein said hydrocarbon is a gas.

9. A process according to claim 8 wherein said gas is selected from the group consisting of methane, ethane, propane, n-butane and i-butane.

10. A process according to claim 9 wherein said gas is propane.

11. A process according to claim 10 wherein said propane is employed to fluidize said calcium carbide and to inject said calcium carbide below the level of molten pig-iron.

12. A process according to claim 1 wherein Component A comprises 85 to 99% by weight of calcium carbide and 1 to 15% by weight of a compound which under the conditions of said pig-iron releases hydrogen, said amounts being based upon the combined weight of said calcium carbide and said compound which under the conditions of said pig-iron releases hydrogen.

13. A process according to claim 1 wherein said compound which under the conditions of said pig-iron releases hydrogen is a hydrocarbon or halogenated hydrocarbon which is solid at room temperature.

14. A process according to claim 13 wherein said hydrocarbon or said halogen hydrocarbon is selected from the group consisting of polyethylene, polypropylene, polyvinyl chloride and polystyrene.

15. A process according to claim 14 wherein said hydrocarbon is polyethylene.

16. A process according to claim 14 wherein said hydrocarbon is polyethylene.

17. A process according to claim 1 wherein said compound which under the conditions of said pig-iron releases hydrogen is a liquid hydrocarbon or halogenated hydrocarbon having a boiling point of 50 to 350° C.

18. A process according to claim 17 wherein said hydrocarbon is absorbed into a porous organic or inorganic material in an amount of at least the weight of said porous organic or inorganic material.

19. A process according to claim 18 wherein said liquid hydrocarbon is absorbed into a polyurethane foam, peat or expanded stone.

20. A process according to claim 1 wherein Component A additionally contains at least one of calcium carbonate, dolomite or diamide lime in an amount such that the volume of carbon dioxide generated is less than the volume of hydrogen generated by said compound which under the conditions of said pig-iron releases hydrogen.

21. A process according to claim 1 wherein Component A additionally contains 1 to 10% by weight of fluorspar, cryolite, colemanite or other constituents which improves the properties of the resultant slag.

22. A process according to claim 1 wherein Component A contains graphite, an organic amine, alcohol, ester or a silicone.

23. A process according to claim 1 wherein the combined amount of calcium carbide and said compound which under the conditions of said pig-iron releases hydrogen is 50% to 85% by weight based upon the combined amount of said calcium carbide, said compound which under the conditions of said pig-iron releases hydrogen and said magnesium.

24. A process according to claim 23 wherein the combined amount of said calcium carbide and said compound which under the conditions of said pig-iron releases hydrogen accounts for 65 to 85% by weight of the combined amounts of said calcium carbide, said compound which under the conditions of said pig-iron releases hydrogen and said magnesium.

25. A process according to claim 23 wherein Component A additionally contains alkaline earth metal carbonate, dolomite or diamide lime up to an amount such that the carbon dioxide volume is equal to the hydrogen volume released by said compound which under the conditions of said pig-iron releases hydrogen, up to 5% by weight of fluorspar and up to 0.5% by weight of a flow promoter.

26. A process according to claim 1 wherein said composition is injected into molten pig iron at a rate of 10 to 100 kg per minute by fluidizing the same and conveying the same via a conveyer line to a point beneath the level of said molten pig-iron employing 3 to 20 liters of conveying gas per kg of said composition.

27. A process according to claim 26 wherein said composition is introduced into said molten pig-iron at a rate of 15 to 80 kg per minute.

28. A process according to claim 26 wherein said pig-iron is disposed in a torpedo ladle.

29. A process according to claim 26 wherein said pig-iron is disposed in a transfer ladle.

30. A process according to claim 26 wherein the conveying gas comprises a hydrocarbon.

31. A process according to claim 26 wherein the conveying gas comprises nitrogen.

32. A composition for desulfurizing pig-iron comprising:

(A) calcium carbide and at least one compound which under the conditions of said pig-iron releases hydrogen; and (B) magnesium.

33. A composition according to claim 32 wherein at least 90% of said of calcium carbide has a particle size of less than 90 μm and at least 50% of said calcium carbide has a particle size of less than 50μm.

34. A composition according to claim 32 wherein said calcium carbide is present in an amount of 85 to 99% by weight based upon the combined weight of said calcium carbide and said compound which under the conditions of said pig-iron releases hydrogen.

35. A composition according to claim 34 wherein Component A additionally contains 1 to 10% by weight of fluorspar, cryolite, colemanite or other constituents that improve the properties of slag.

36. A composition according to claim 34 wherein Component A additionally contains up to 5% by weight of fluorspar.

37. A composition according to claim 34 wherein said composition additionally contains up to 0.5% by weight of a flow promoter.

38. A composition according to claim 34 wherein the combined amount of said calcium carbide and said compound which under the conditions of said pig-iron releases hydrogen is 50 to 85% by weight based upon the combined amount of calcium carbide, said compound which under the conditions of said pig-iron releases hyrdrogen and said magnesium.

39. A composition according to claim 38 wherein the combined amount of said calcium carbide and said compound which under the conditions of said pig-iron releases hydrogen accounts for 65 pl to 85% by weight based upon the combined amount of said calcium carbide, said compound which under the conditions of said pig-iron releases hydrogen and said magnesium.

40. A composition according to claim 34 wherein said compound which under the conditions of said pig-iron releases hydrogen is a hydrocarbon or a halogenated hydrocarbon which is solid at room temperature.

41. A composition according to claim 40 wherein said solid is selected from the group consisting of polyethylene, polypropylene, polyvinyl chloride and polystyrene.

42. A composition according to claim 41 wherein said compound which under the conditions of said pig-iron releases hydrogen is polyethylene.

43. A composition according to claim 40 wherein said solid is selected from the group consisting of polypropylene.

44. A composition according to claim 34 wherein said compound which under the conditions of said pig-iron releases hydrogen is a liquid hydrocarbon or halogenated hydrocarbon whose boiling point is 50 to 350° C.

45. A composition according to claim 44 wherein said liquid hydrocarbon or halogenated halocarbon is absorbed into a porous organic or inorganic material and is present in an amount at least that of the weight of said organic or inorganic porous material.

46. A composition according to claim 45 wherein said organic or inorganic material is polyurethane foam, peat or an expanded stone.

47. A composition according to claim 34 wherein said hydrocarbon is a gaseous hydrocarbon.

48. A composition according to claim 47 wherein said gaseous hydrocarbon is propane.

49. A composition according to claim 34 wherein said composition contains an alkaline earth metal carbonate, dolomite or diamide lime in an amount such that the volume of carbon dioxide generated is less or equal to the volume of hydrogen generated by said compound which under the conditions of said pig-iron releases hydrogen.

* * * * *

UNITED STATES PATENT AND TRADEMARK OFFICE

CERTIFICATE OF CORRECTION

PATENT NO. : 4,592,777

DATED : June 3, 1986

INVENTOR(S) : Heinrich Rellermeyer, et al.

It is certified that error appears in the above-identified patent and that said Letters Patent are hereby corrected as shown below:

| | |
|---|---|
| Col. 2, line 32 | Correct spelling of --temperature-- |
| Col. 2, line 53 | Insert --eutectic-- before " "carbide" " |
| Col. 3, line 1 | Insert --,-- after "ethane" |
| Col. 3, line 14 | Delete "1to" and substitute --1 to-- |
| Col. 4, line 6 | Delete "ladel" and substitute --ladle-- |
| Col. 8, line 9 | Delete "p1" before "to" |

Signed and Sealed this

Eleventh Day of November, 1986

*Attest:*

DONALD J. QUIGG

*Attesting Officer* *Commissioner of Patents and Trademarks*